US007766757B2

(12) United States Patent
Brooks et al.

(10) Patent No.: US 7,766,757 B2
(45) **Date of Patent: *Aug. 3, 2010**

(54) GOLF SWING DEVICE

(75) Inventors: Patrick H. Brooks, Centreville, VA (US); Chris A. Ries, Alexandria, VA (US); Roy T. Phillips, Fairfax, VA (US)

(73) Assignee: Fairway Golf Center, LLC, Centreville, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/022,383

(22) Filed: Jan. 30, 2008

(65) Prior Publication Data

US 2008/0214319 A1 Sep. 4, 2008

Related U.S. Application Data

(63) Continuation-in-part of application No. 11/976,694, filed on Oct. 26, 2007, now Pat. No. 7,648,422.

(60) Provisional application No. 61/012,151, filed on Dec. 7, 2007, provisional application No. 60/898,399, filed on Jan. 31, 2007.

(51) Int. Cl.
*A63B 69/36* (2006.01)

(52) U.S. Cl. ..... 473/215; 473/226

(58) Field of Classification Search ..... 473/207, 473/212–226, 257, 266, 276; 482/115, 124, 482/127

See application file for complete search history.

(56) References Cited

U.S. PATENT DOCUMENTS 1,962,256 A 6/1934 Nelson et al.
2,103,502 A 12/1937 Webster
3,680,869 A 8/1972 Brady
3,804,420 A 4/1974 Boyd
3,861,688 A 1/1975 Butler
4,135,714 A 1/1979 Hughes
4,181,310 A 1/1980 Boehmer
4,714,244 A 12/1987 Kolomayets et al.
4,991,850 A * 2/1991 Wilhlem ..... 473/233
5,318,491 A 6/1994 Houston
5,423,547 A 6/1995 Puso
5,439,214 A 8/1995 Dalbo
5,486,149 A 1/1996 Smith et al.
5,697,572 A 12/1997 Salentine et al.
5,816,928 A 10/1998 Colonna
5,871,406 A * 2/1999 Worrell ..... 473/221
5,879,240 A 3/1999 Stuart
5,938,137 A 8/1999 Poulson
6,149,559 A 11/2000 Mackey
6,270,430 B1 8/2001 Nicoloff
6,413,196 B1 7/2002 Crowson
6,458,036 B1 10/2002 Gutierrez
6,591,461 B2 7/2003 Salentine et al.
6,659,922 B1 12/2003 Yu
6,800,035 B1 10/2004 Couch
6,863,616 B2 3/2005 Snyder et al.
6,966,519 B2 11/2005 Salentine et al.

(Continued)

*Primary Examiner*—Nini Legesse
(74) *Attorney, Agent, or Firm*—KED & Associates, LLP

(57) ABSTRACT

A golf device is provided that includes a storage mechanism to store information related to a desired swing of a golf club, and a swing identifying device to identify when the golf club has moved a desired distance based on the stored information related to the desired swing.

12 Claims, 7 Drawing Sheets

U.S. PATENT DOCUMENTS

| | | | | |
|---|---|---|---|---|
| 7,021,140 | B2 * | 4/2006 | Perkins | 73/493 |
| 7,101,287 | B1 * | 9/2006 | Wagner | 473/207 |
| 7,134,968 | B1 | 11/2006 | Pryor | |
| 2003/0073492 | A1 * | 4/2003 | Tosaki et al. | 463/37 |
| 2003/0109324 | A1 | 6/2003 | Novotny | |
| 2004/0097296 | A1 | 5/2004 | Snyder et al. | |
| 2004/0229708 | A9 | 11/2004 | Novotny | |
| 2005/0261073 | A1 * | 11/2005 | Farrington et al. | 473/221 |
| 2006/0063600 | A1 * | 3/2006 | Grober | 473/224 |
| 2006/0084516 | A1 * | 4/2006 | Eyestone et al. | 473/219 |
| 2006/0111197 | A1 * | 5/2006 | Yamamoto et al. | 473/151 |

* cited by examiner

FIG. 5
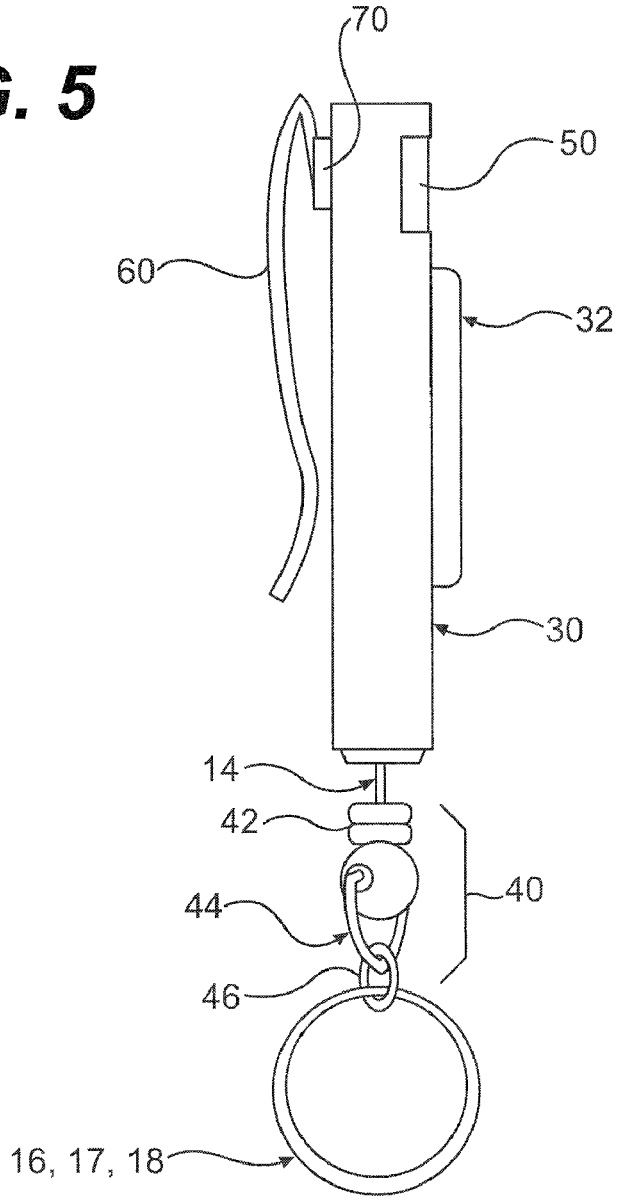
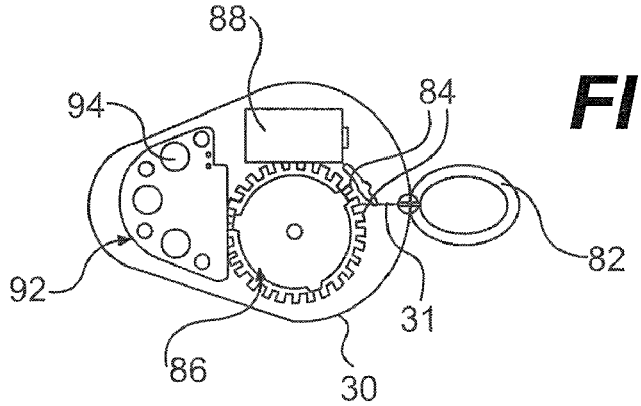
FIG. 6

GOLF SWING DEVICE

This application is a Continuation-In-Part of U.S. application Ser. No. 11/976,694, filed Oct. 26, 2007, now U.S. Pat. No. 7,648,422 which claims priority from U.S. Provisional Application No. 60/898,399, filed Jan. 31, 2007. The present application also claims priority from U.S. Provisional Application No. 61/012,151, filed Dec. 7, 2007. The subject matters of U.S. application Ser. No. 11/976,694 and U.S. Provisional Application Nos. 60/898,399 and 61/012,151 are incorporated herein by reference.

BACKGROUND

1. Field

Embodiments of the present invention may relate to a device to train and/or aid a golfer when performing a swing (or stroke) of a golf club or other apparatus.

2. Background

A golf swing of a golf club may be an important aspect of the game of golf. The golf swing involves at least an addressing of the golf club with the golf ball, a backswing of the golf club to a specific backswing position (or point) and a forward swing (or follow through) of the golf club from the specific backswing position to hit the golf ball.

The backswing of the golf club to a specific position is often based on a desired distance to hit the golf ball. In other words, a golfer may take a larger backswing for a further shot or a golfer may take a shorter backswing for a shorter shot. In order to take a proper or desired amount of backswing, golfers often take practice swings prior to hitting the golf ball (during an actual swing). These practice swings include the golfer mentally determining and/or remembering how far back to take a backswing.

BRIEF DESCRIPTION OF THE DRAWINGS

Embodiments of the present invention may be described in detail with reference to the following drawings in which like reference numerals refer to like elements and wherein:

FIG. 5 shows a side view of a swing training device according to an example embodiment of the present invention;

FIG. 6. shows a swing training device according to an example embodiment of the present invention;

DETAILED DESCRIPTION

Embodiments of the present invention may relate to a swing training device to aid golfers in performing golf swings. The swing training device may also be referred to as the Automatic Swing Training device (or TAST device). The swing training device may also be applicable to other sports, such as tennis, baseball and softball. Embodiments of the present invention may relate to a swing training device that allows a golfer to take a backswing to a desired position/point and/or a desired amount or length of a backswing. The desired position of the backswing may be determined previously such as during a practice backswing. The swing training device is able to inform the golfer (e.g. through an audible sound, through a visual display and/or by not allowing a cord to further extend) that the backswing has reached the desired position and/or desired amount of a backswing. This may allow the user to perform a golf swing having a desired backswing. Embodiments of the present invention may also relate to a forward swing (or forward movement).

Figure 1B:
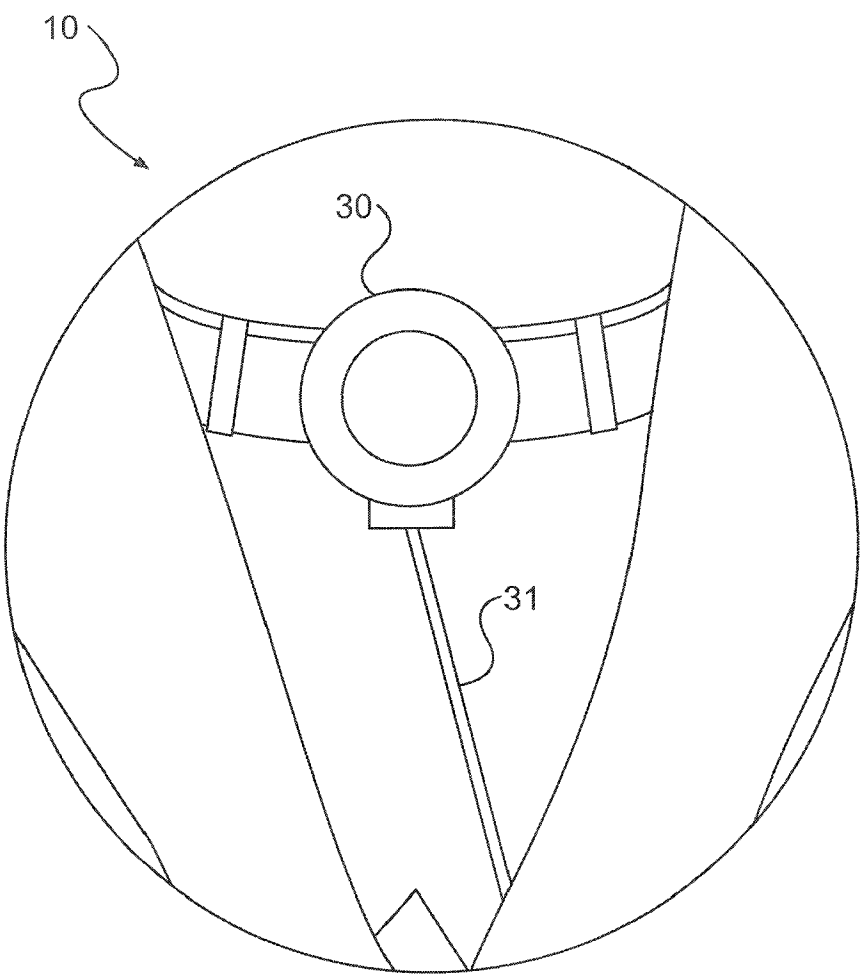
FIG. 1B shows an enlarged view of section 10 of FIG. 1A.
Figure 1A:
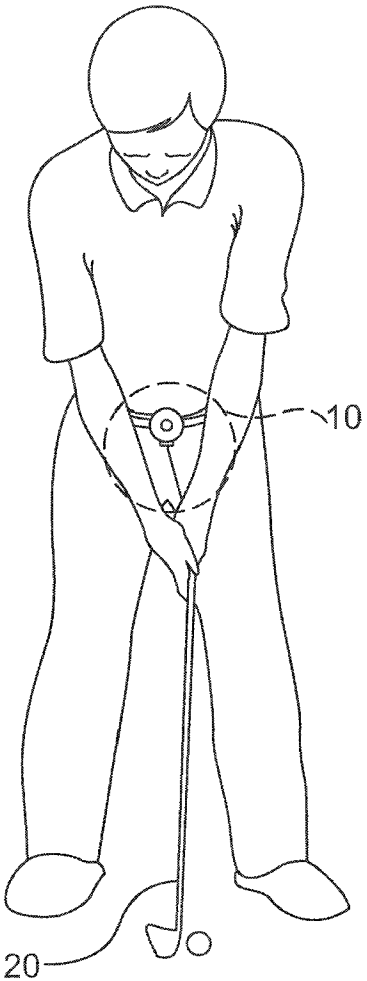
FIG. 1A shows a golfer having a golf swing training device according to an example embodiment of the present invention.

FIG. 1A shows a golfer having a golf swing training device according to an example embodiment of the present invention. Other embodiments and configurations are also within the scope of the present invention. More specifically, FIG. 1A shows a golfer holding a golf club 20 in a position of addressing a golf ball with the golf club. The golf club 20 may be coupled (or connected) to the swing training device shown within section 10. The swing training device may also be coupled (or connected) to a hand or a finger of the golfer.

FIG. 1B shows an enlarged view of the section 10 in which the swing training device is also attached to a belt (or pants) of the golfer. The swing training device may attach to items other than the belt of the golfer, such as the pants of the golfer or to a harness-like device, for example.

As shown in FIG. 1B, the swing training device may include a housing 30 and a cord 31 (or flexible member) that extends from the housing 30 and connects to the golf club 20, a hand of the golfer and/or a finger of the golfer, for example. Embodiments may hereafter refer to element 31 as a cord (and/or a flexible member or a pull cord). The cord 31 may be made of nylon, cotton, fish line, metal, etc. The cord 31 may also be considered a flexible member, a cable and/or a line. The cord 31 may also be coupled to a finger loop that loops around the golfer's finger. As one example, the loop may be a polyurethane finger loop.

During a backswing, a golfer's hand and the golf club both move relative to an initial position (i.e., relative to a position in which the golf club addresses the golf ball.) Since one end of the cord 31 is attached (or connected) to the hand or the finger of the golfer (or to the club), movement of the golfer's hand (and the club) during the backswing may extract (or extend) the cord 31 from the housing 30. The other end of the cord 31 may be attached to the housing 30 so that the cord 31 does not easily separate from the housing 30. The housing 30 may include a retracting mechanism to retract the cord 31 back into the housing 30 when the golfer returns the golf club 20 back close to the golf ball (i.e., back to the initial position). Stated differently, the retracting mechanism retracts the cord 31 back into the housing 30 when a distance between the golfer's hand (and the club) and the housing 30 lessens or when the cord 31 becomes disconnected from the golfer's hand (or the golf club). Accordingly, the cord 31 may be extracted (or extended) from the housing 30 and may be retracted back into the housing 30. An amount of the cord 31 that is extracted from the housing 30 may be determined.

As one example, the retracting mechanism may include a double acting pull cord drum around which the cord 31 is provided. The cord 31 may extend from the housing 30 and from around the drum when the cord is pulled by the user (such as in a backswing). The drum may also retract the cord 31 back into the housing based on rotational force provided by a constant force coil spring provided in the housing 30. Other retracting mechanisms may also be provided.

Embodiments of the present invention may also be applicable to a swing training device that does not use a cord. Rather, a distance of a practice backswing (or a backswing) may be determined based on non-cord devices such as sonar, infrared, laser, etc. These non-cord devices may be used to determine how far a butt of a club, or a hand, or any other part of the club has moved (or traveled) from an initial position. This may involve having a first transmitting/receiving device at or in the housing 30 and a second transmitting/receiving device on the golf club 20, the butt end of the golf club 20 or on a hand of the golfer, for example. The first and second transmitting/receiving devices may communicate with each other to determine a distance and/or position of movement using sonar, infrared, laser, etc. The first and second transmitting/receiving devices may be referred to as a determining device to determine when the club has moved to a desired distance from a previous distance.

Figure 2B:
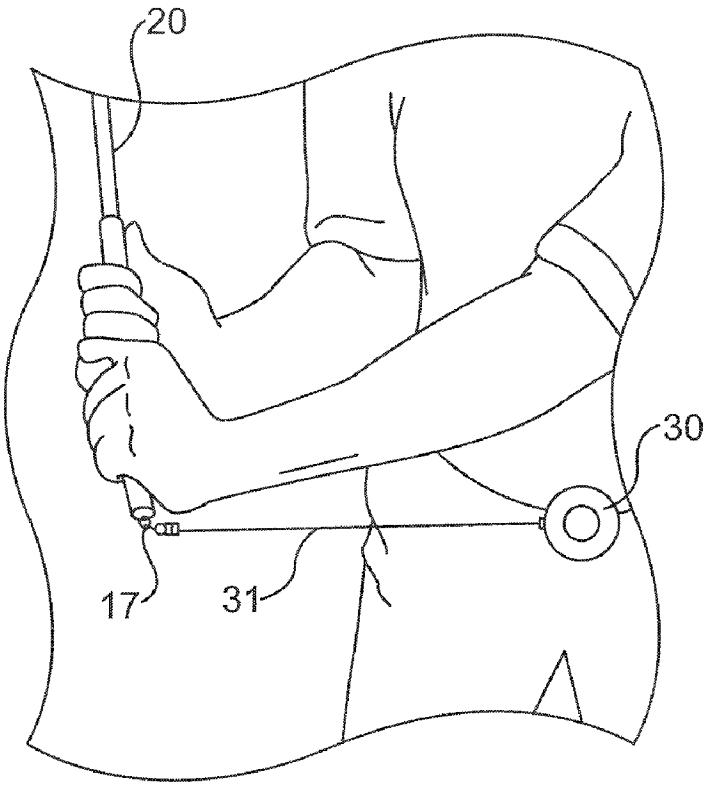
FIG. 2B shows a swing training device coupled to a butt end of a golf club according to an example embodiment of the present invention.
Figure 2A:
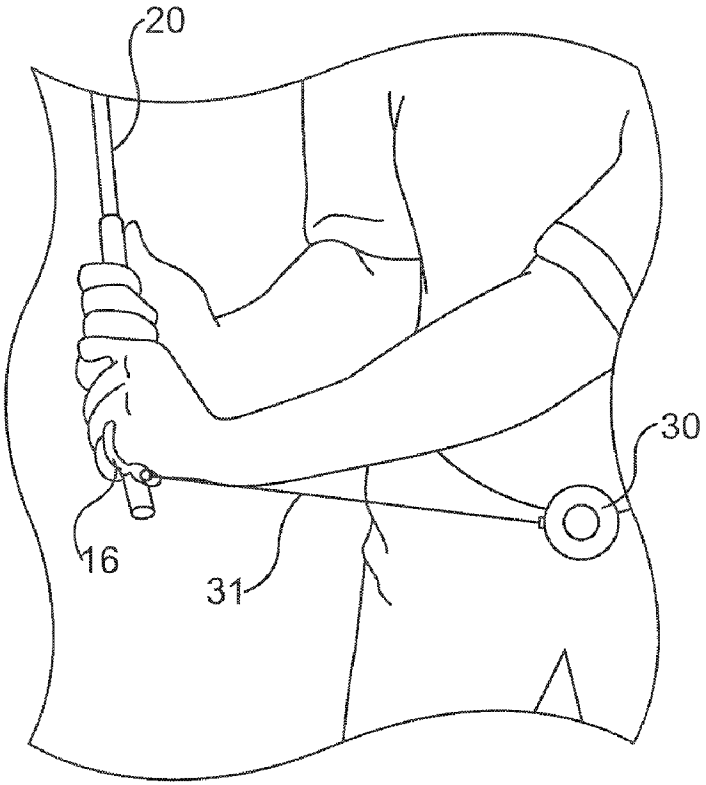
FIG. 2A shows a swing training device coupled to a golfer's finger according to an example embodiment of the present invention.

FIG. 2A shows a swing training device coupled to a golfer's finger according to an example embodiment of the present invention. Other embodiments and configurations are also within the scope of the present invention. More specifically, FIG. 2A shows that the swing training device further includes a connecting device 16 that is connected (or coupled) to one end of the cord 31. The connecting device 16 may attach to a finger of the golfer such as when the golfer desires to use the swing training device. The connecting device 16 shown in FIG. 2A may be a ring or loop to be provided on the golfer's finger (and/or around the golf club). FIG. 2A specifically shows the connecting device 16 as a ring (or loop) around a pinky of the golfer's left hand. Other types of a connecting member and/or mechanism to couple with the cord 31 are also within the scope of the present invention.

FIG. 2B shows a swing training device coupled to a butt end of a golf club according to an example embodiment of the present invention. Other embodiments and configurations are also within the scope of the present invention. More specifically, FIG. 2B shows that the swing training device further includes a connecting device 17 that is coupled to one end of the cord 31. The connecting device 17 may also attach (or connect) to a butt end of the golf club 20 and/or to a tee (or other device) at a butt end of the golf club 20.

During use, a golfer may take a practice backswing to a desired backswing position. The desired backswing position may be determined/desired based on a distance that the golfer desires to hit a golf ball during an actual swing. Upon reaching the desired backswing position, the swing training device may store, program, maintain and/or identify information regarding the desired backswing position. This information may correspond to an amount of the cord 31 that has been extracted (or extended) from the housing 30 during the practice backswing to the desired backswing position. The information may also correspond to a distance that a portion of the club 20 or the golfer's hand has moved or traveled from an initial position. For example, the information may be determined based on the amount of the cord 31 that has been extracted or based on a distance measured/determined based on a non-cord device. This information may be provided within an electronic device (such as memory) or within a mechanical device of the housing 30.

After performing the practice swing, the golfer may then perform an actual swing at the golf ball (i.e., to hit the golf ball). In order to accomplish this, using the swing training device, the golfer may execute a backswing to the desired backswing position and subsequently hit the golf ball when swinging the golf club 20. During the backswing, the golfer may be informed by the swing training device of the desired backswing position by an audible sound, a visual indicator and/or by feel of the cord 31 (based on a resistance of extracting/retracting the cord 31). This indication may inform the golfer to stop backswing (or backward) movement of the golf club 20 since the desired backswing position has been reached. The golfer may also be informed by the swing training device of the desired backswing position by the swing training device not allowing the cord 31 to be extracted any more from the housing 30. Upon reaching the desired backswing position, the golfer may swing the golf club 20 forward to hit the golf ball. The swing training device allows the golfer to take a backswing to a desired backswing position. This desired backswing position may have previously been determined based on an expected distance to hit a golf ball.

More specifically, the swing training device may operate, in at least one embodiment, such that when the golfer takes a practice backswing as shown in FIG. 2A, the cord 31 extends from or is extracted from the housing 30 to a length that is dictated by the backswing of the golfer. When the golfer reaches the desired backswing position, the cord 31 has extended a specific length from the housing 30. The specific length is indicative of the golfer's desired backswing for a future backswing (e.g. during an actual swing/stroke). At the desired backswing position in the practice backswing, the golfer may depress a button or other mechanism on the housing 30 so as to store, program, maintain and/or identify information related to the specific length of the cord 31 that has been extracted or extended from the housing 30. This information may be used in a subsequent backswing such as immediately prior to the golfer actually hitting a golf ball. The golfer may also store, program, maintain and/or identify information related to movement of the golf club and/or the golfer's hand. This information may also be obtained in response to a golfer's voice, for example. Because the swing training device has information to perform a desired backswing, the swing training device may audibly and/or physically inform the golfer when the golf club has again reached the desired backswing position. That is, during an actual swing, when the golf club 20 has reached the desired backswing position, the golfer may then swing the golf club in a forward manner and hit the golf ball. After the golfer hits the golf ball (or attempts to hit the golf ball), the golf club 20 may continue in a forward manner. This may hereafter be referred to as a forward swing or follow-through swing. During the follow-through swing, the golfer may be informed by the swing training device of a specific (or desired) forward swing position by an audible sound, a visual indicator and/or by feel of the cord 31. This indication may inform the golfer of the specific forward motion/position of the golf club 20.

Embodiments of the present invention are also applicable to storing, programming, maintaining and/or identifying information of a swing by techniques other than depressing a button. For example, a golfer may speak a specific voice command that is recognizable by the swing training device. The information may be stored, programmed, maintained and/or identified based on the voice command.

The swing training device may include photo-interrupters within the housing 30. The photo-interrupters may sense rotation of the rotating drum (discussed above) by sensing teeth of the drum. The photo-interrupters (and processor) may therefore determine a distance in which the cord 31 was pulled (as well as a direction of rotation of the drum).

The swing training device allows a golfer to store, program, maintain and/or identify information related to a desired backswing (and/or a forward follow-through swing). This information may be stored, programmed, maintained and/or identified during a practice swing and may then be used during an actual swing at the golf ball. The information may be stored, programmed, maintained and/or identified at other time periods such as during an actual swing and/or a plurality of actual swings based on an average swing or distance that a ball has traveled. The swing training device may also include electronic components to store specific information related to a desired backswing. For example, this information may be programmed into a memory (or memory device) to allow the device to store, program, maintain and/or identify the information. Accordingly, embodiments of the present invention may allow the golfer to appropriately store, program, maintain and/or identify information relating to a backswing using the training device. This information may be used during an actual swing to enable a golfer to take a backswing to a specific position. Embodiments of the present invention are also applicable to storing, programming, maintaining and/or identifying information of more than one backswing.

Figure 3B:
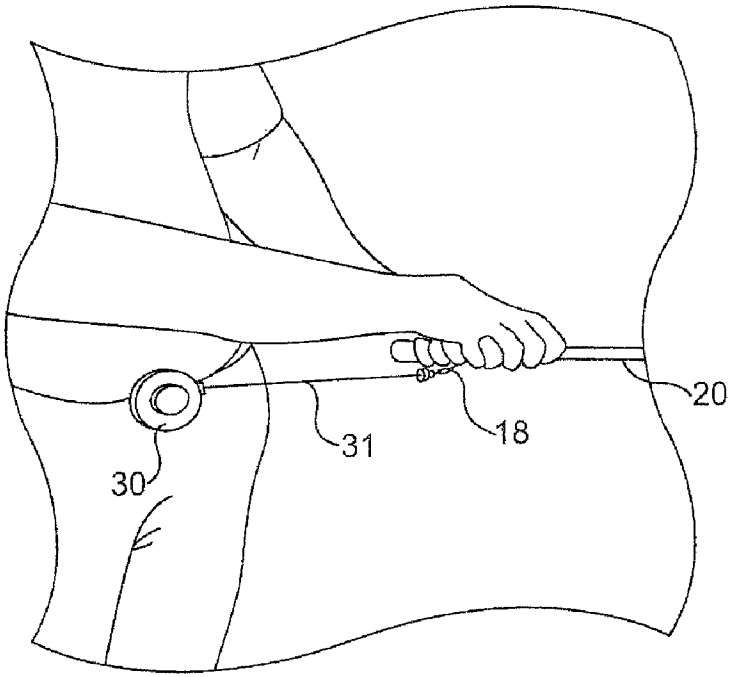
FIGS. 3A and 3B show a swing training device coupled to a golf club according to an example embodiment of the present invention.
Figure 3A:
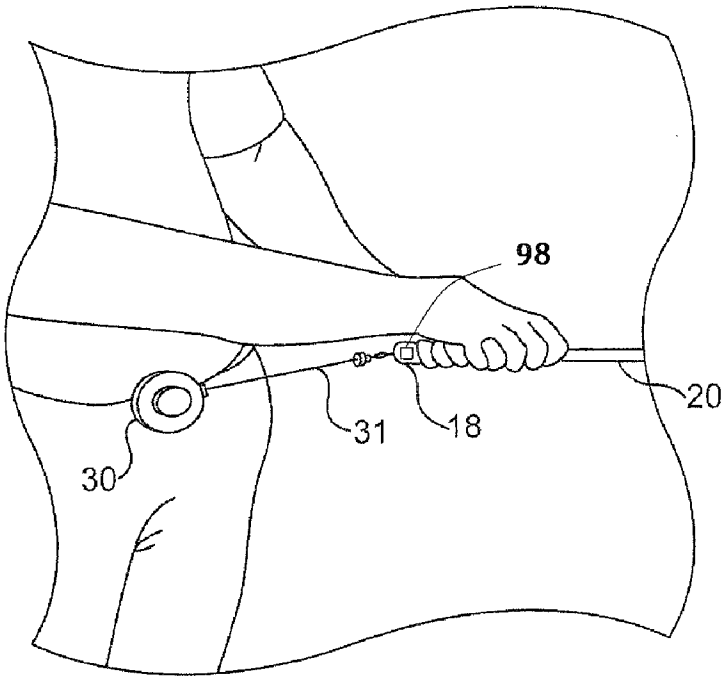

FIGS. 3A and 3B show a swing training device coupled to a golf club according to an example embodiment of the present invention. Other embodiments and configurations are also within the scope of the present invention. More specifically, FIG. 3A shows the swing training device includes a connecting device 18 that is coupled to one end of the cord 31. The connecting device 18 may attach to a butt end of the golf club 20 as shown in FIG. 3A. As another example, the golfer may insert a golf tee (or other device) into the butt end of the golf club 20 and then attach or connect the connecting device 18 to the golf tee (or other device).

FIG. 3B shows the connecting device 18 attached to an area of the golf grip of the golf club 20. The swing training device in FIGS. 3A and 3B may operate in a similar manner as discussed above so as to allow a user to store, program, maintain and/or identify information of a backswing and subsequently use that information to provide a better backswing.

Figure 4:
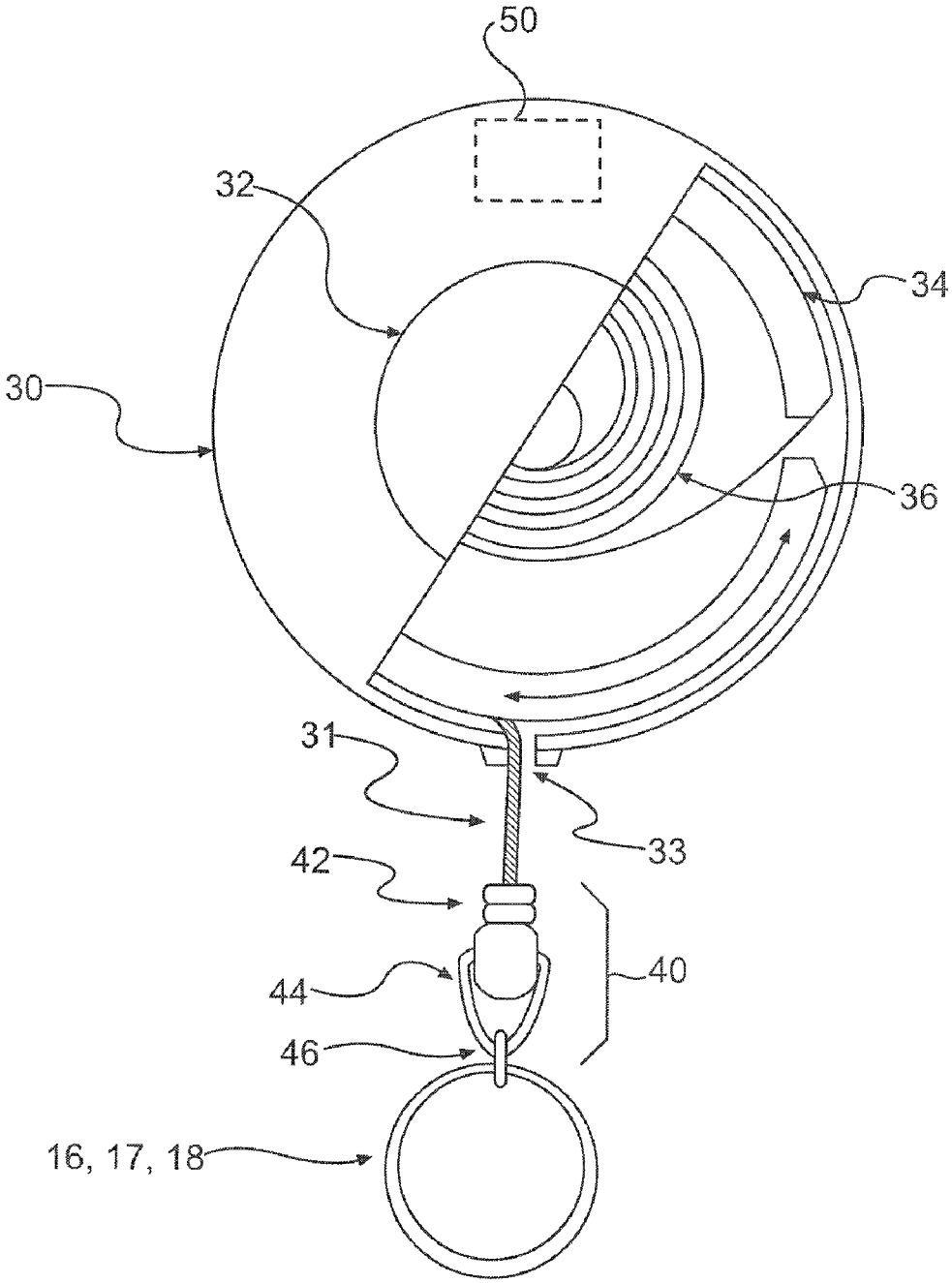
FIG. 4 shows a swing training device according to an example embodiment of the present invention.

FIG. 4 shows a swing training device according to an example embodiment of the present invention. Other embodiments and configurations are also within the scope of the present invention. More specifically, the swing training device may include the housing 30 to house or store the cord 31 such as when the cord 31 is retracted. The cord 31 may be housed in the housing 30 in a coiled manner about a metal spring coil 36, for example. One end of the cord 31 may be attached to the housing 30 (e.g. at a central area) to prevent the cord 31 from being released from the housing 30. The housing 30 may also include a guide 34 and the spring coil 36 to guide the coil 31 when retracting into the housing 30 and to guide the coil 31 when extending or extracting outside of the housing 30 through an aperture 33. The aperture 33 may be on any one of the surfaces or sides of the housing 30, such as a top surface, a bottom surface or a side surface. The housing 30 may also include a diaphragm 32 (or button) that may be engaged (or depressed) by the golfer so as to store, program, maintain and/or identify information related to a specific length of the cord 31 that has been extracted or extended from the housing 30. This information is indicative of a desired backswing level. For example, a golfer may depress the diaphragm 32 when a specific amount of cord 31 has been extracted or extended from the housing 30.

FIG. 4 also shows that the swing training device includes a swing identifying device 50 to provide an audible noise, for example, when the cord 31 is extracted from the housing 30 a specific amount based on the previously identified information relating to the backswing. The audible noise may be a beep, for example. The swing identifying device 50 may also provide a visual indication when the cord 31 is extracted from the housing 30 by the specific amount. The swing identifying device 50 may also display an expected distance that a golfer may hit a golf club at that extended amount of the cord 31 (based on previous data). Still further, the swing identifying device 50 may also provide resistance to the cord 31 or stop the extraction of the cord 31 when the cord 31 is extracted from the housing 30 by the specific amount. Accordingly, the swing identifying device 50 may identify when the golf club 20 is in a desired position. The swing identifying device 50 may also appropriately identify a specific distance of a backswing, for example, from an initial position.

The information related to the desired backswing may be stored in an electronic component such as a memory. The information may also be stored by mechanical means. For example, the depressing of the diaphragm 32 may cause portions of the cord 31 within the housing 30 to move from one position to another (e.g. from one spring coil to another spring coil). The retracted portion of the cord 31 may be provided on one of the two spring coils and the remaining portion of the cord 31 may be provided on another one of the two spring coils. A mechanical device to perform these operations is considered to have stored, programmed, maintained and/or identified information related to a desired backswing.

The housing 30 may be of a circular shape, a square shape or other shape. The housing 30, the diaphragm 32 and the guide 34 may be formed of plastic, although other materials may also be used.

FIG. 4 also shows that the swing training device includes an attachment mechanism 40 to attach the connecting device 16 (or 17 or 18) to the cord 31. The attachment mechanism 40 may include components such as a swivel 42, a ring (or loop 44) and a clamp 46. The attachment mechanism 40 may be considered part of the cord 31.

FIG. 5 shows a side view of a swing training device according to an example embodiment of the present invention. Other embodiments and configuration are also within the scope of the present invention. More specifically, FIG. 5 shows a clip 60 (or clasp) that may be provided on a back surface of the housing 30. The clip 60 may attach to a golfer's belt, pants and/or other device. The housing 30 may also include a swivel 70 provided on the back surface of the housing 30 to allow the housing 30 to swivel in a circular manner relative to the clip 60 based on a player's range of motion (such as when the golfer takes a backswing).

FIG. 6 shows a swing training device according to an example embodiment of the present invention. Other embodiments and configurations are also within the scope of the present invention. FIG. 6 shows components that may be provided within the housing 30 as well as the cord 31 and a connecting device (such as a finger loop 82) to connect to a user's pinky finger. The components may include a double acting pull cord drum 86 and photo-interrupters 84 coupled to (or mounted on) a printed circuit board (not shown). The photo-interrupters 84 may be provided about the drum 86 to sense teeth of the drum 86 as the drum 86 rotates about a central axis. A power source 88 (such as a 3-volt battery) may be provided within the housing 30. The power source 88 may include a device to store a charge, such as from an AC voltage source. Still further, a printed circuit board 92 may also be provided within the housing 30 and include a programmable memory controller and/or a memory device to perform various operations as discussed above, such as storing, programming, maintaining and/or identifying information.

Figure 7:
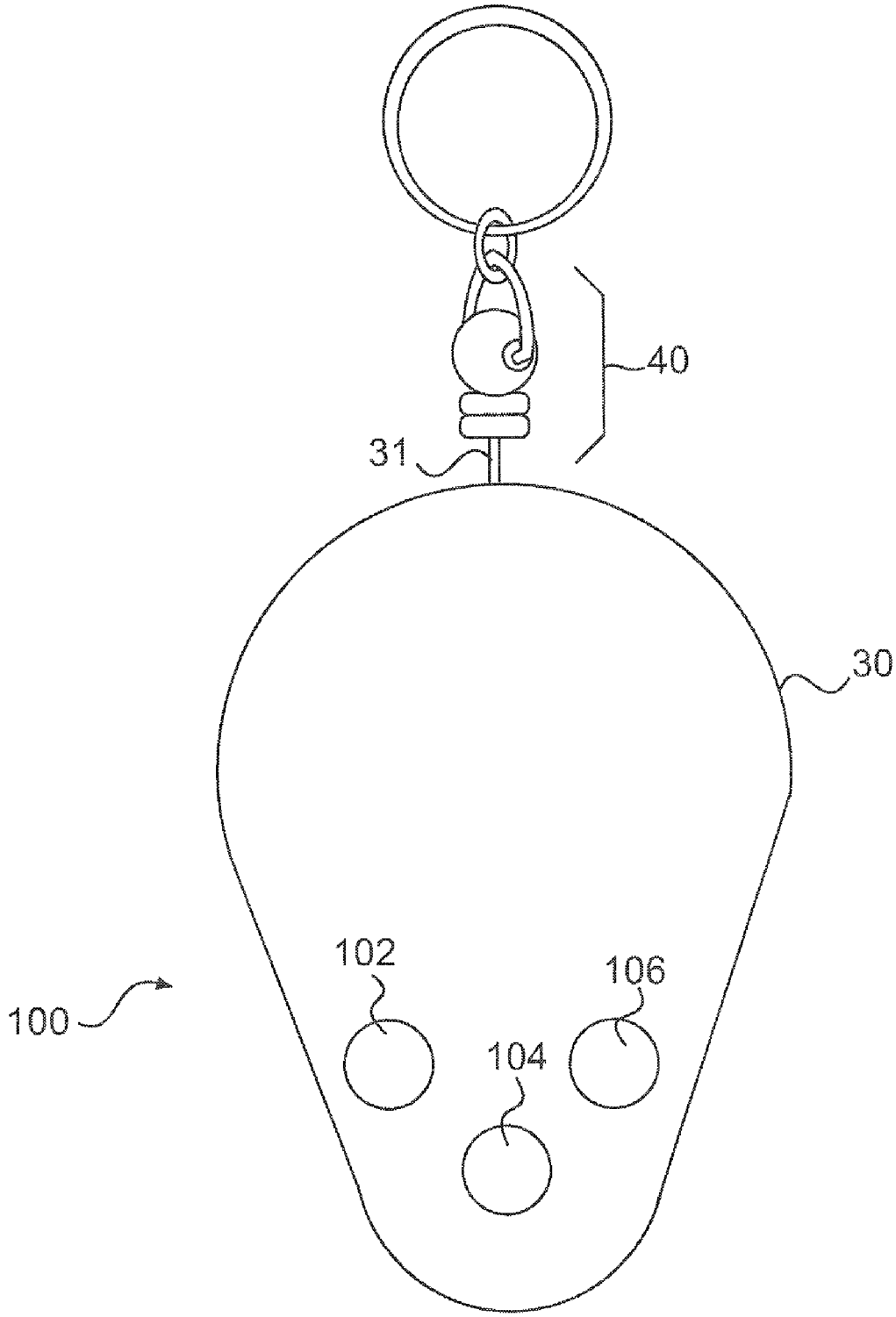
FIG. 7 shows a top surface of a swing training device according to an example embodiment of the present invention.

Various buttons 100 (or keys) may also be provided for use by the user. The buttons 100 may be electrically or mechanically coupled to the printed circuit board 92. The buttons 100 may be exterior to the housing 30 to allow the user to input information, obtain information or program information. FIG. 7 shows a top surface of a swing training device according to an example embodiment of the present invention. The buttons 100 may include three memory buttons 102, 104 and 104 to store or obtain information related to three different distances based on an amount of the cord 31 extracted from the housing 30 or based on a distance of a backswing from an initial position. Other numbers of memory buttons 100 (or function control buttons) may also be provided.

FIG. 7 shows a shape of the housing 30 that may be applicable to each of the other embodiments discussed above and/or hereafter. FIG. 7 further shows the attachment mechanism 40 to attach the connecting device (such as the loop) to the cord 31. However, embodiments of the present invention are also applicable to using sonar, infrared and/or a laser rather than the cord 31 in order to determine a distance of a backswing.

The golfer may select a first memory button 102 to select (or store) a first backswing amount. The first backswing amount may correspond to a first desired distance to hit a golf ball. The stored information may correspond to a first amount of cord to be extracted or to a desired distance of a backswing from an initial position. The golfer may select a second memory button 104 to select (or store) a second backswing amount. The second backswing amount may correspond to a second desired distance to hit a golf ball. The stored information may correspond to a second amount of cord to be extracted or to a desired distance of a backswing from an initial position. Additionally, the golfer may select a third memory button 106 to select (or store) a third backswing amount. The third backswing amount may correspond to a third desired distance to hit a golf ball. The stored information may correspond to a third amount of cord to be extracted or to a desired distance of a backswing from an initial position. Other function buttons may also be provided such as power on/off buttons.

A programmable memory coupled to (or mounted on) the printed circuit board 92 may store different pull cord distance settings (such as for the memory buttons) or different amounts of distances of a backswing. The memory controller and/or memory may also signal an audible device to provide a signal from a speaker (not shown) when a specific distance of the cord 31 has been extracted from the housing 30. For example, the memory controller may activate a memory distance for each of the stored amounts of cord to be extracted (i.e., the stored distance of a backswing).

The swing training device may further store information related to different distances to hit a golf ball using a specific club. The information may have been previously entered into the memory. A user interface may allow a user to select a club and/or select (or input) a distance to hit a golf ball. The swing training device may then obtain information from memory regarding the amount of the backswing based on the entered information. The amount of the backswing may be an amount of the cord 31 to extract from the housing 30 or the distance from an initial swing position to a specific swing position.

The swing training device may further include input/output ports to allow various external devices to couple to the swing training device. For example, ports may be provided on the housing 30 to allow connection to a computer, a PDA, an MP3 player/receiver, etc. The ports may allow information and/or software to be downloaded into the swing training device and/or to extract information from the swing training device.

The swing training device also allows a user to maintain and/or store information regarding specific desired distances in which to hit a golf ball. This information may be obtained based on past performances of a specific golfer. This information may be entered into the swing training device via a computer or another input device. The swing training device may include a capability to compute a desired distance that the cord 31 should be extracted from the housing 30 (or a distance of a backswing) based on a desired distance that a golfer wants to hit a golf ball. For example, if a golfer wants to hit a golf ball 150 yards with a specific golf club, then the golfer may enter the desired distance and the specific club into the swing training device. Based on information within the memory of the swing training device, a specific backswing position may be provided in order to hit the golf ball the specific distance. The data within the swing training device is not a guarantee of the actual distance that the golf ball will travel, but rather is an indication of past performance. The swing training device may indicate the specific amount of the cord 31 that needs to be extracted in order to correspond to the golfer's average distance for a specific swing or may indicate the distance of the backswing.

The swing training device may therefore appropriately indicate to the golfer when the desired amount of the cord 31 has been extracted from the housing 30 to correspond to the desired distance to hit a golf ball (and based on the stored information and the entered information). The swing training device may also indicate to the golfer when the specific distance of the backswing has been reached using a non-cord device, such as sonar, infrared or laser that determines a distance in which a golf club is moved from an initial position. As stated above, the golfer may be informed through audible or visual indications that the desired backswing position has been reached.

The swing training device may also determine a desired backswing position based on an entered distance in which to hit a golf ball. For example, if a golfer wants to hit a 60 yard shot, then the golfer may enter 60 yards into the swing training device via an input device. The swing training device may then determine an amount of the cord 31 that needs to be extracted during a backswing or a distance of the backswing. Stated differently, by entering a specific distance into the swing training device, the swing training device may determine an amount of distance that the cord 31 should be extracted in order to obtain the desired backswing position and/or to determine an amount of distance of the backswing from the initial backswing.

The swing training device may include a memory that stores numerous data for a specific person (or data obtained from another source). This data may include distances that a golf ball has traveled for a specific club based on the specific backswing of the golfer. In other words, the memory may store data related to a specific backswing position and a corresponding distance traveled by the golf ball for that specific backswing position (and for a specific golf club). The distance traveled by a golf ball may be entered by a user at the time of the golf swing or may be automatically entered using electronic components. For example, a GPS system may determine a distance that a golf ball has traveled. This information may be entered into the swing training device (or other device) and be stored so as to correspond to a specific backswing of a user. Stated differently, the golf swing training device may appropriately record the distance that the golf ball has traveled based on the previous backswing of the golfer. This information may then be stored into the golf swing training device and/or may be used to alter data already stored within the swing training device, such as for computing an average distance and/or a desired distance for a golf ball.

As one example, when a golfer hits a golf ball 60 yards, a chip or other device in the golf ball may communicate with the swing training device to determine an exact distance the golf ball has traveled. This data may then be stored in the swing training device along with the information regarding the backswing position of the backswing. This information may therefore be updated in real time. This information may be used by the golfer for future computations and determinations of backswings.

Operation of the swing training device will now be discussed. The swing training device may be placed on the golfer body such on the belt or belt buckle at one's midsection. The button 102 may be depressed until a confirmation beep is provided. The golfer may then place a finger in the loop.

The golfer may then take a practice swing from an initial position to a specific backswing position and wait for a brief period of time, such as three seconds. The swing training device may then provide a setting beep that locks the backswing position into memory either temporarily or permanently. This may set a specific backswing position for the button 102. The swing training device may subsequently set different backswing positions using a similar methodology for each of the other buttons 104 and 106.

During use, the golfer may select a previously stored desired distance to hit a ball. In the following example, the golfer may select to hit a ball 150 yards. This data may have been previously stored with respect to the button 102. The button 102 may also correspond to a specific backswing position. The swing training device may then be turned on by depressing one of the buttons, such as the button 102, or other button/device. The depressing of the button 102 also informs the swing training device that the golfer desires information relating to setting #1, which corresponds to the button 102. The information relating to setting # may be a specific desired distance (to hit a golf ball) and information related to the backswing.

The golfer may then provide their finger through the loop and assume a set up position (or initial position). The golfer may then take a backswing until a beep (or other indication) is provided, which means that the desired backswing position has been reached. The beep (or other indication) reminds/warns/tells that the golfer has reached the desired backswing position. The golfer may then start their downswing and swing through the ball (and hit the ball). The golfer continues the downswing and continues into the follow-through swing. The swing training device may then provide a second beep (or other indication) which indicates that the follow-through swing has reached the symmetric forward position (as compared to the backswing position). The second beep (or follow-through beep) informs the golfer that a swing has been completed.

Figure 8:
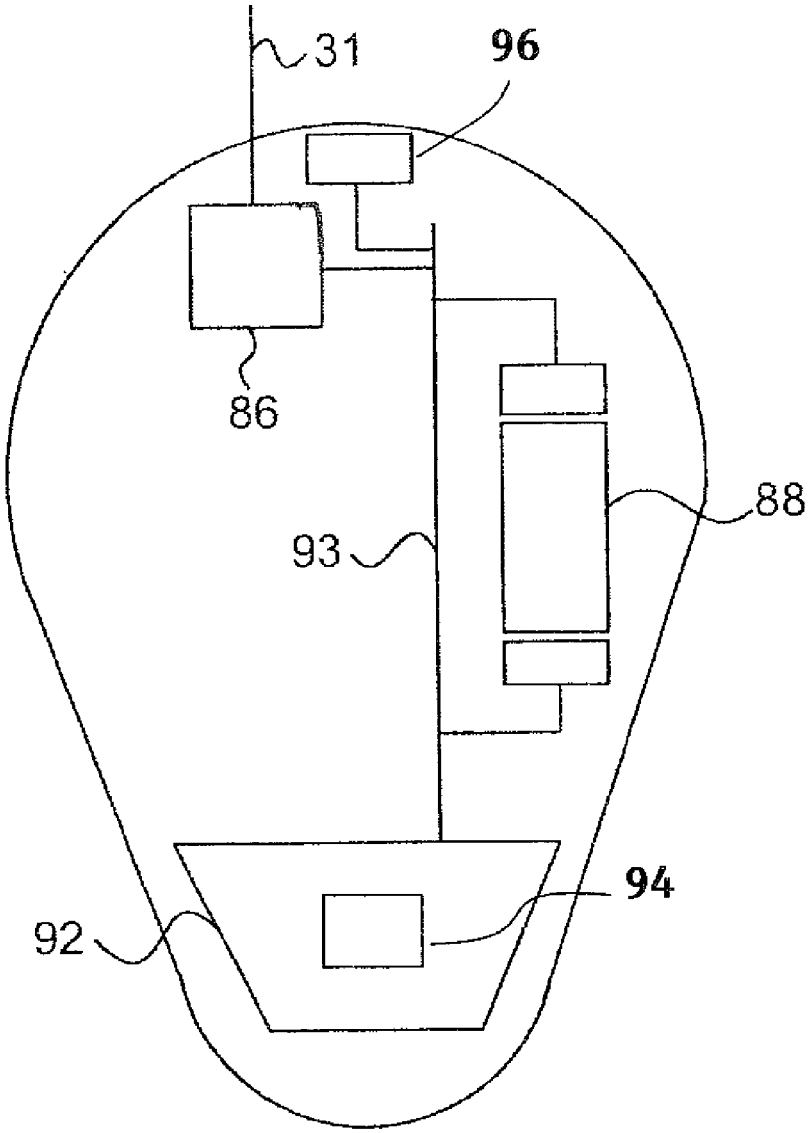
FIG. 8 shows an inside view of a swing training device according to an example embodiment of the present invention.

FIG. 8 shows an inside view of a swing training device according to an example embodiment of the present invention. As shown, inside the housing 30, the printed circuit board 92 may be coupled via a connecting device 93, such as wires, to the power source 88 and to the drum 86 (as in FIG. 6). FIG. 8 also shows a memory 94 (or memory device). As discussed above, the housing 30 may contain a non-cord device (i.e., a first transmitting/receiving device 96) to communicate via sonar, infrared, laser, etc., regarding a distance that a golf club in a golfer's hand has moved. For example, the housing 30 may include the first transmitting/receiving device 96 located at an area of housing 30 similar to where the cord 31 is shown in FIGS. 6-8 exiting the housing 30. As discussed above, a second transmitting/receiving device 98 may be provided at one of the golf club, the golfer's hand or the golfer's finger, such as part of a ring or loop. As one example, the second transmitting/receiving device 98 may be provided at or near any one of the connecting devices 16, 17 and 18 (shown in FIGS. 2A-5). FIG. 3 shows the second transmitting/receiving device 98 provided at the butt end of the golf club. The first and second transmitter devices 96, 98 communicate with each other to determine an amount of movement of the golf club from a first position to a second position.

Embodiments of the present invention are applicable to the swing training device to identify when the golf club has reached a desired position relative to a starting position based on stored information. The golfer may be informed by an audible sound, by a visual indicator, by a change in resistance of the cord being extended from outside of the housing and/or by the cord being denied an ability to extend any further. Other techniques of informing the golfer are also within the scope of the present invention.

Embodiments of the present invention may have a capability to extend a cord from a housing and then to set an indicator identifying the set position. The cord may then be rewound (or retracted) into the housing. The swing training device may then have a set distance so that each time the golfer swings, the cord will extend from the housing and stop (or indicate by an audible noise or visual indicator) at the pre-measured or pre-set point and then rewind back into the housing time after time until the golfer chooses a new distance.

While the above description relates to a swing training device for use with a golf club, embodiments of the present invention may also be applicable to other types of sports equipment (e.g. tennis, hockey) and or other types of equipment that involve a swing and/or a stroke. Additionally, the above described device may be used during training and/or actual golfing.

Embodiments of the present invention are also applicable to a user entering information into the swing training device by electronic means. For example, a golfer may enter information into the swing training device through a key pad or by downloading the information into a memory of the swing training device. This information may correspond to a desired backswing for different desired distances that a golfer desires to hit a golf ball. The desired backswing information may correspond to a specific length that the cord 31 should extend from the housing 30 or may correspond to a desired distance of movement from a first position of the club to a second position (i.e., a desired position) of the club. This information may also be altered by the golfer or by way of a processor (such as based on a golfer's actual swing). As another example, a golfer may further enter information into the swing training device relating to an actual distance that a golf ball travels. This information may then be used to alter the stored information based on the specific backswing position and the actual distance of the golf ball. A processor may also implement an averaging technique or other technique to determine a desired backswing position based on previous performances of hitting the golf ball.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A golf device comprising:

a memory to store information related to a desired swing of a golf club;

a swing identifying device to audibly identify when the golf club has moved a specific distance based on the stored information in the memory related to the desired swing;

a housing to house the memory and the swing identifying device; and a cord to extend from the housing upon movement of the golf club, wherein the swing identifying device identifies when the cord extends from the housing by the specific distance.

2. The golf device of claim 1, wherein the swing identifying device provides an audible sound when the golf club has moved the specific distance.

3. The golf device of claim 1, wherein the swing identifying device includes a visual indicator device to visually identify when the golf club has moved the specific distance.

4. The golf device of claim 1, wherein the swing identifying device includes a resistance mechanism to change a resistance of the cord that extends from the housing.

5. The golf device of claim 1, further comprising a determining device to determine when the golf club has moved the specific distance from a previous position.

6. The golf device of claim 5, wherein the determining device includes a first transmitting/receiving device in the housing, and a second transmitting/receiving device is provided at one of the golf club, the golfer's hand or the golfer's finger.

7. The golf device of claim 6, wherein the first and second transmitting/receiving devices communicate with each other to determine a distance or position of movement of the golf club.

8. The golf device of claim 7, wherein the first and second transmitting/receiving devices utilize one of sonar, infrared and laser to communicate with each other.

9. A golf device comprising:

a housing including:

a first transmitting/receiving device;

a memory to store information related to a distance of movement of a golf club;

a swing identifying device to audibly identify when the golf club has moved a specific amount of distance based on information stored in the memory; and a cord to extend from the housing upon movement of the golf club, wherein the swing identifying device identifies when a specific amount of the cord extends from the housing, and a second transmitting/receiving device to be provided at one of the golf club, a golfer's hand or a golfer's finger, wherein the first and second transmitting/receiving devices to communicate with each other to determine an amount of movement of the golf club from a first position to a second position, wherein the swing identifying device audibly identifies when the determined amount of movement corresponds to the specific amount of distance.

10. The golf device of claim 9, wherein the swing identifying device provides an audible sound when the golf club has moved the specific amount of distance.

11. The golf device of claim 9, wherein the swing identifying device includes a visual indicator device to visually identify when the golf club moves the specific amount of distance.

12. The golf device of claim 9, wherein the first and second transmitting/receiving devices utilize one of sonar, infrared and laser to communicate with each other.

* * * * *